US006037318A

United States Patent [19]

Na et al.

[11] Patent Number: 6,037,318

[45] Date of Patent: Mar. 14, 2000

[54] PROCESS FOR MANUFACTURING BLEACHING COMPOSITIONS COMPRISING CHLORINE AND BROMINE SOURCES AND PRODUCT THEREOF

[75] Inventors: Henry Cheng Na; Michael Charles Frazee; James Charles Theophile Roger Burckett St. Laurent, all of Cincinnati; Kyle David Jones, West Chester, all of Ohio; Marco Petri, Angera Varese, Italy

[73] Assignee: The Procter & Gamble Company, Cincinnati, Ohio

[21] Appl. No.: 09/180,711

[22] PCT Filed: May 15, 1996

[86] PCT No.: PCT/US96/07089

§ 371 Date: Nov. 13, 1998

§ 102(e) Date: Nov. 13, 1998

[87] PCT Pub. No.: WO97/43392

PCT Pub. Date: Nov. 20, 1997

[51] Int. Cl.[7] ..... C11D 3/395; C11D 3/48; C11D 9/42

[52] U.S. Cl. ..... 510/379; 510/370; 510/380; 510/405; 510/499

[58] Field of Search ..... 510/367, 370, 510/379, 380, 405, 499

[56] References Cited

U.S. PATENT DOCUMENTS

| | | | |
|---|---|---|---|
| 2,815,311 | 12/1957 | Ellis et al. | 167/18 |
| 3,583,922 | 6/1971 | McClain et al. | 252/99 |
| 3,749,672 | 7/1973 | Golton et al. | 252/95 |
| 4,279,764 | 7/1981 | Brubaker | 252/99 |
| 4,822,512 | 4/1989 | Auchincloss | 252/106 |
| 4,883,600 | 11/1989 | MacDonald et al. | 210/696 |
| 5,565,109 | 10/1996 | Sweeny | 210/755 |
| 5,683,654 | 11/1997 | Dallmier et al. | 422/14 |
| 5,942,126 | 8/1999 | Dallmier et al. | 210/756 |

FOREIGN PATENT DOCUMENTS

| | | | |
|---|---|---|---|
| 0 119 560 | 9/1984 | European Pat. Off. | C11D 3/395 |

*Primary Examiner*—Mark Kopec
*Assistant Examiner*—John M Petruncio
*Attorney, Agent, or Firm*—Richard S. Echler, Sr.; Kim W. Zerby; Brian M. Bolam

[57] ABSTRACT

An improved process for the manufacture of alkaline bleaching compositions, especially liquid and/or gel compositions of high solubility and low abrasiveness, useful to the consumer, especially as products for hard surface cleaning, bleaching or disinfectancy. The products are made by a three-stage process and comprise particular chlorine and bromine bleach sources and particular aminofunctional materials such as low-impurity sulfamate. The process has mixing sequences and starting ingredient selections which provide unexpectedly improved product

20 Claims, 1 Drawing Sheet

PROCESS FOR MANUFACTURING BLEACHING COMPOSITIONS COMPRISING CHLORINE AND BROMINE SOURCES AND PRODUCT THEREOF

FIELD OF THE INVENTION

The present invention relates to a process for the manufacture of alkaline bleaching compositions useful to the consumer, especially as products for hard surface cleaning, bleaching or disinfectancy. The products comprise both chlorine and bromine bleach sources. The process has mixing sequences and starting ingredient selections which provide unexpectedly improved product.

BACKGROUND OF THE INVENTION

Hard surface cleaners, bleaches and disinfectants are well known formulated consumer products. They are useful for treating all manner of soiled kitchen, bathroom, sink, tub, shower, toilet bowl and counter top surfaces.

Such consumer products are known to include hypochlorite bleach. Hypochlorite is desirable for its high effectiveness as a bleach and disinfectant. However, it has several disadvantages, including that it can sometimes be too aggressive, tends to leave an unpleasant odor on the hands, and is not always stable on storage in a consumer product formulation.

Bromine containing compounds have been used in specialized circumstances for bleaching or disinfectancy. However they tend to be expensive and are often even more demanding in terms of storage stability than the chlorine analogs.

Sulfamic acid has been used as a cleaner, especially in acidic cleaners delivering high concentrations of the acid.

The chemistry of sulfamate-containing systems with halogens is extraordinarily complex and research in this area continues to this day.

Despite the partly known features of the art, there is an ongoing need for hard surface cleaners, bleaches and disinfectants suitable for consumer use which are improved in one or more of their characteristics including having superior effectiveness as a bleach and disinfectant, being less aggressive, tending to leave very low odor or even pleasant odor on the hands, and being highly stable on storage.

Accordingly, an improved process for making such compositions is provided herein, and the alkaline bleaching compositions secured thereby.

The process herein has several advantages, including that it is easy to operate and is safe and effective for its intended purpose. Surprisingly, it delivers a product which is actually superior to the product which is achieved when numerous other mixing sequences are employed.

BACKGROUND ART

Commonly assigned U.S. Pat. No. 3,583,922, Mc Clain and Meyer, Jun. 8, 1971 and Canadian Patent Publ. CA 860279 A, published Jan. 5, 1971 describe a solid composition for rapid removal of tannic acid stains having pH not less than 10.5 consisting of 0–95% abrasive, up to 10% surfactant, 0–60% alkaline builder, a stable compound, preferably chlorinated trisodium orthophosphate, to provide 0.5%–5% available chlorine, sulfamic acid to produce preferably a ratio of Cl to sulphamic add of 500 to 1:1, preferably 3:1 to 6:1, optionally with additives. Such additives can include bromides, perfumes or borax. The compositions can be adjusted for sink cleaning or mechanical dish washing.

JP 63108099 A, Lion Corp., published May 12, 1988 describes a bleaching agent for controlling chlorine odor containing a specific ratio of hypochlorite and sulfamic acid and/or sulfamate and pH adjusting agents. The ratio is 2–8 wt% hypochlorite based on "the amount of the effective chlorine" (sic) and there is a 0.25 to 1.5 mol ratio of sulfamic acid, and/or a sulfamate, to hypochlorite.

JP 63161088 A, Lion Corp., published Jul. 4, 1988 describes bleaching compositions for cloth comprising mainly hydrogen peroxide and sulfamic acid and/or water-soluble sulfamate and hypohalous acid and/or a water-soluble hypohalite salt such as NaClO, $Ca(OCl)_2$, bleaching powder or NaBrO, the sulfamate being present in an amount of 0.5–5 mol per mol hypohalite.

U.S. Pat. No. 4,992,209, Feb. 12, 1991, Smyk et al describes a bactericidal, fungicidal system having a nitrite-containing corrosion inhibitor, for example cooling systems, prepared by reacting NaBr with NaOCl or $Cl_{12}$ and sodium sulfamate or sulfamic acid and the product is assertedly "reacted within 5 hours of preparation".

U.S. 5,431,839, Guillou, Jul. 11,1995 describes sulfamic acid cleaning/stripping compositions comprising heteropolysaccharide thickening agents. U.S. Pat. No. 5,047,164, Sep. 10, 1991, Corby, describes compositions containing interhalogens and acid especially adapted for cleaning and disinfecting milk- and food-handling equipment. U.S. Pat. No. 4,279,764, Brubaker, Jul. 21, 1981 describes encapsulated bleaches comprising storage stable chlorinated isocyanurates. U.S. Pat. No. 4,233,173, Mayer et al, Nov. 11, 1980 and U.S. Pat. No. 4,201,687, Crutchfield et al describe detergent compositions containing chloroimidodisulfate bleaching agent. U.S. Pat. No. 5,470,499, Choy et al, Nov. 28, 1995 describes thickened aqueous abrasive cleansers with improved rinsability. Commonly assigned U.S. Pat. No. 4,051,056, Sep. 27, 1977, Hartman describes abrasive scouring compositions with perlite and hypochlorite bleach. Commonly assigned U.S. Pat. No. 3,715,314, Morgenstern, Feb. 6, 1973 describes scouring cleanser compositions. Commonly assigned U.S. Pat. No. 5,384,061, Wise, Jan. 24, 1995 describes stable thickened aqueous bleaching compositions comprising chlorine bleach and phytic acid. Industrial uses of sulfamic acid are included in a literature review, see "Inorganic Sulfur Chemistry", G. Nickless, Ed., Elsevier, 1968, Chapter 18, "Amido- and Imido-sulphonic acids", 607–667 and references cited therein; see also Kirk Othmer Encyclopedia of Chemical Technology, 3rd Ed., Wiley-Interscience, Vol. 21, "Sulfamic Acid and Sulfamates", pp 949–960. Chloramines, Bromamines and N-halamines more generally are reviewed in Kirk Othmer's Encyclopedia of Chemical Technology, Wiley-Interscience, 4th Ed., Vol. 5, pp 911–932; see also a corresponding article in the 3rd edition of the same Encyclopedia. Chlorine gas has previously been mixed with solutions containing sulfamic acid: see Korshak et al., Zh. Obsch. Khim., Vol. 18 (1948), pages 753–756, but the mixture decomposed.

SUMMARY OF THE INVENTION

The present invention encompasses a process for manufacturing an alkaline bleaching composition, preferably an aqueous liquid bleaching composition, said process comprising at least three stages. These stages include, in sequence (I) a pre-bromine stage, (II) a bromine compound addition stage, and (III) a product stabilization stage, and each of said stages has at least one mixing step.

In said process, said pre-bromine stage, (I), comprises a step, (a), of mixing in any order components comprising a hypochlorite source and an aminofunctional compound having a stable N-halo derivative; thereby forming a stage (I) mixture; provided that at the end of said pre-bromine stage, said stage (I) mixture has a pH not exceeding about 11, preferably lower; said bromine compound addition stage, (II), is Initiated at said pH and comprises a step, (b), of mixing in any order with said stage (I) mixture, a bromine compound; thereby forming a stage (II) mixture; and said product stabilization stage, (III), comprises at least one step, (c), of mixing in any order with said stage (II) mixture, an alkali in an amount suitable to arrive at a final pH for the product of said process of at least about 13.

The product provided by this process has unique advantages in terms of excellent bleaching effect at the same time as permitting a minimization of "bleach odor" on skin. The preferred product is a transparent yellow aqueous liquid, which may optionally be thickened and/or perfumed.

All percentages, ratios, and proportions herein are on a weight basis unless otherwise indicated. All documents cited are hereby incorporated by reference in their entirety.

DETAILED DESCRIPTION OF THE INVENTION

Figure 1:
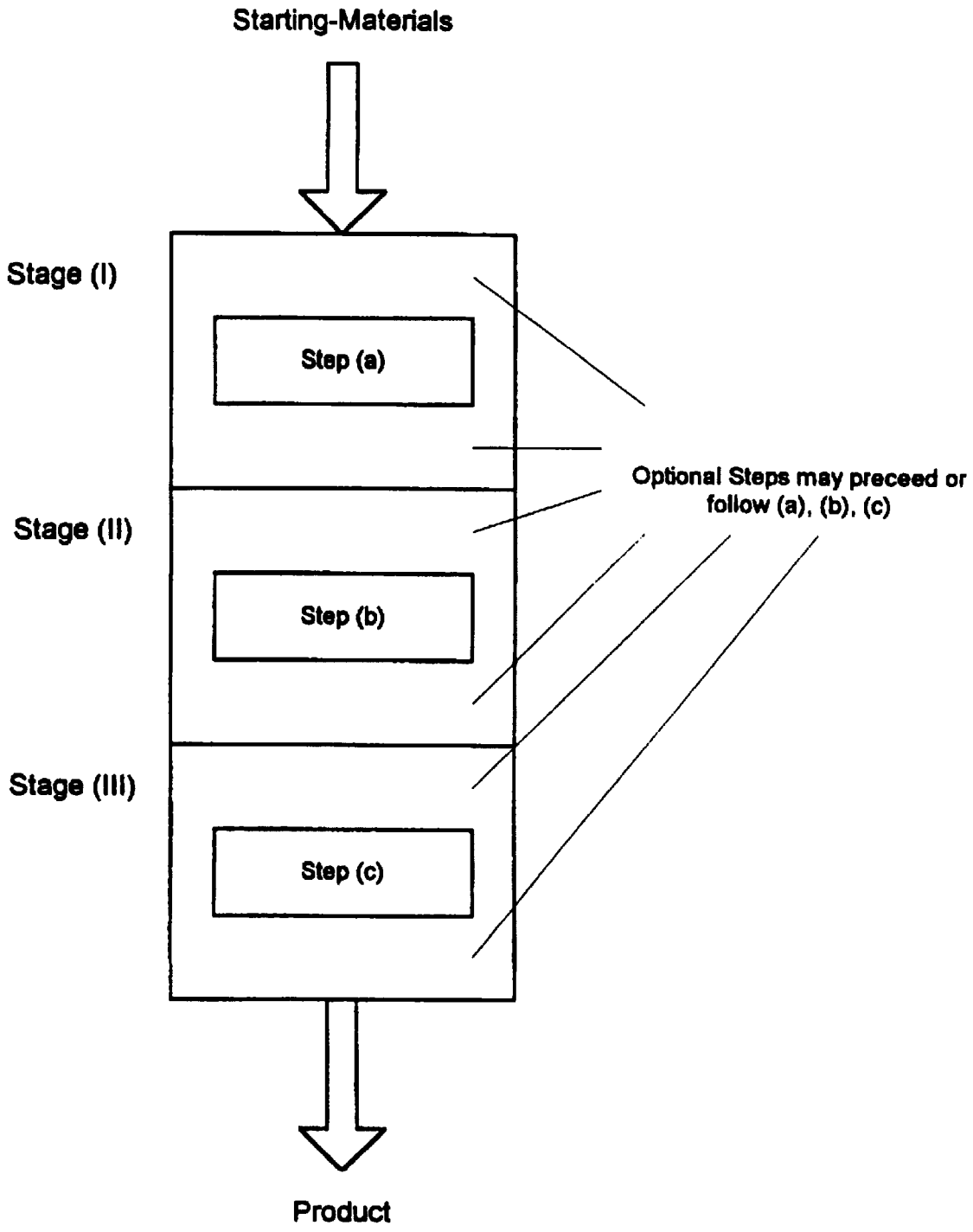
FIG. 1 represents a schematic outline of the present process, showing the conversion of starting-materials (ingredients) to product via a series of stages, comprising, in sequence, Stage (I), Stage (II) and Stage (III). Each stage, as indicated, includes one or more steps. Stage (I) includes an essential step, namely Step (a). Stage (II) includes an essential step, namely Step (b), and Stage (III) includes an essential Step, namely step (c). The present process in the most reduced form which can be constructed from FIG. 1 consists of the sequence of three steps (a) followed by (b) followed by (c). Each of the essential stages and steps, as well as suitable ingredients and characteristics of the product are described in detail hereinafter.

In accordance with the present invention, it has been discovered that in order to secure an alkaline bleaching composition having superior technical performance and desirability for the consumer, it is necessary to provide two distinct types of halogen ingredient including at least one having, at the outset, the form of a bromine compound and at least one having, at the outset, the form of a hypohalit compound. It has also been found essential to particularly select and include a certain aminofunctional compound; and to provide a particular process, especially in terms of mixing sequence, to secure the product benefits.

Alkaline Bleaching Compositions

Accordingly, the present invention relates to processes for making alkaline bleaching compositions and to the products thereof. "Alkaline bleaching compositions" as defined herein are strongly alkaline. The "alkaline bleaching compositions" herein have a pH as is of at least about 13, and are made from ingredients comprising a hypophalite soure and a bromine compound along with at least one particularly selected aminofunctional compound. Alkaline beaching compositions herein are useful to the consumer as products for hard surface cleaning, bleaching or disinfectancy. They can, in general, have any suitable physical form, such as granular, tablet, paste, gel or liquid form, and can be aqueous or non-aqueous. However, the process herein is especially well adapted for making aqueous, alkaline, liquid-form or gel-form bleaching compositions: technical problems of processing are greatest for such compositions. Unless otherwise noted, embodiments hereinafter which illustrate the processes and product of the invention therefore relate to the aqueous liquid forms.

Process Stages

Processes herein generally comprise at least three stages:

(I) a pre-bromine stage;

(II) a bromine compound addition stage, and (III) a product stabilization stage.

The stages are carried out in the order (I) then (II) then (III). The stages are identified in FIG. 1. Each stage includes one or more steps. In a minimum configuration, the process includes, in Stage (I), step (a); in Stage (II), step (b), and in Stage (III), step (c). Additional steps, for example of adding and/or mixing other ingredients such as perfumes, surfactants and the like, may be inserted before or after any of the essential steps, provided that they do not affect the indicated sequence of essential steps and further, that they are perfomed compatibly with respecting the pH criticalities described herein.

In more detail, Stage (I), the pre-bromine addition stage, is a stage used to bring together a hypochlorite source and a particular aminofunctional compound; Stage (II), the bromine compound addition stage, is a stage used to introduce a bromine compound; and stage (III), the product stabilization stage, is a stage used to stabilize the product by increasing pH.

Thus the invention encompasses a process for manufacturing an alkaline bleaching composition, said process comprising at least three stages including, in sequence, (I) a pre-bromine stage, (II) a bromine compound addition stage, and (III) a product stabilization stage, each of said stages having at least one mixing step; wherein in said process, said pre-bromine stage comprises a step, (a), of mixing in any order components comprising a hypochlorite source and an aminofunctional compound having a stable N-halo derivative; thereby forming a stage (I) mixture; provided that at the end of said pre-bromine stage, said stage (I) mixture has a pH not exceeding about 11; said bromine compound addition stage is initiated at said pH and comprises a step, (b), of mixing in any order with said stage (I) mixture, a bromine compound; thereby forming a stage (II) mixture; and said product stabilization stage comprises at least one step, (c), of mixing in any order with said stage (II) mixture, an alkali in an amount suitable to arrive at a final pH for the product of said process of at least about 13.

Particularly preferred processes herein are restrictive in terms of when the bromine compound may be added. In preferred processes, no stage other than (II) and no step other than (b) comprises adding a bromine compound. Surprisingly, it has been found that adding bromine compound elsewhere in the sequence has a negative impact on product performance.

Optional Process Steps

The present process can include various optional steps. An optional step useful herein is illustrated by a dilution step, included in the process after completion of stage (III). Such a step as a dilution step can in fact be carried out either by the manufacturer, or by the user of the product of stages (I), (II) and (III). Dilution steps can in general be included in stage (I), stage (II) or stage (III) of the present process, though prefereably, dilution is avoided in those stages. Typically for best storage stability, a dilution step is not carried out in the plant, but rather, by the consumer who uses the composition. Dilution can result in pH variation, typically including pH decrease. Other optional steps useful herein include surfactant addition steps, or steps of adding or mixing any suitable optional ingredient, such as those identified under "optional ingredients" hereinafter.

Process Means

Any suitable means may be employed for accomplishing the present process. Reactors are desirably chemically inert to halogen bleach and strongly alkaline conditions, plastics and/or borosilicate glass lined apparatus is desirably used both for durability and to minimize contamination of the product by metals. Reactors need not be designed for operation under pressure provided that suitable venting is provided. Mixing of ingredients can be accomplished using any suitable mixer, such as a motor-driven paddle. Alternately, a centrifugal pump can be used to provide a recirculating jet of product solution, driving agitation of the mixture. Other useful process means herein include means for removing vapors from the work environment. Such means include conventional scrubbers, etc.

Process Conditions

Temperature

In general the present process can be carried out at widely ranging temperatures. Preferably, each of said steps (b) and (c) is performed at a temperature in the range from about 5° C. to about 80° C., preferably from about 10° C. to about 45° C., most preferably at or about ambient temperature, e.g., about 20° C. Highly preferred process herein accomplish all steps in stages (I), (II) and (III) at such temperatures. At higher temperatures, there may be an increased decomposition tendency and at lower temperatures, freezing can be a problem.

pH's

The present process requires particular limits on pH variation. There is a general requirement that at the end of the pre-bromine stage and at the beginning of the bromine stage, the pH of the stage (I) mixture is not in excess of about 11. In preferred embodiments, this pH is not in excess of about 8, more preferably, it lies in the range from about 1 to about 6.9.

In preferred embodiments, from the end of stage I, the entire process is conducted at a rising pH. Such rising pH desirably corresponds with a value of dpH/dt of at least about +0.1 pH units/min, preferably about +0.5 pH units/min, or higher.

In such embodiments, it will be appreciated that the instant process contains a pH minimum. The position in the overall sequence of the present process of this minimum is found at the end of stage (I).

Pressure

The present process can be conducted at any convenient pressure. For example, chlorine gas and alkali can be reacted under pressure, for example up to about 5 atm., in stage (I) prior to adding the aminofunctional compound; and the following stages of the process can be conducted at atmospheric pressure, or even at reduced pressure if scrubbers or condensers are provided for collecting lost halogen. Preferred processes are conducted at atmospheric pressure.

Time

The present process can be conducted in batch or continuous mode. Unless otherwise indicated, illustrations of the process hereinafter are batch-mode. Times for completion of a batch may in general vary widely. Typically, times of about 5 min to about 1.5 hours are typical for each of stages (I), (II) and (III). In preferred embodiments, Stage (II) will allow at least sufficient time to permit the bromine compound to substantially dissolve before proceeding with stage (III). Also preferably, stage (II) is continued until development of a yellow color in the stage (II) mixture. In general, the longer process times are associated with larger-scale processes. It is preferred herein to minimize the overall reaction time, and in particular, while allowing sufficient time for stage (II), to proceed without delay from that stage to the end of stage (III). Moreover, it is highly preferred to minimize any time period between the end of step (a) and the beginning of step (b), and between the end of step (b) and the beginning of step (c).

Concentration and Concentration Ratios

The present process can be conducted over a wide range of concentrations of the ingredients in water. In preferred embodiments, the process is characterized by a dilution factor for the sum of stages subsequent to stage (I) which is not in excess of about twofold. In general, concentrations of the ingredients are adjusted such that the product of stage (III), comprises from about 0.01% to about 10% Available Chlorine. Also, in terms of relative proportions of the ingredients, the present process preferably relies on an interhalogen ratio [Br] : [$OCl^-$] of from about 10: 1 to about 1: 10, preferably 1:2 to 1:5, wherein [Br] represents total moles Br added into said process from said bromine compound and [$OCl^-$] represents total moles hypochlorite added into said process from said hypochlorite source. Moreover, the preferred processes herein employ an amino-halo ratio [A]: [X] of from about 10: 1 to about 1: 10, wherein [A] represents the total of moles of amino moieties of said aminofunctional compound used to form said composition and wherein [X] represents total moles of bleaching halogen, measurable as Available Chlorine, added into said composition.

Very preferably, said amino-halo ratio is from about 1.0: 1.0 to about 1.5: 1.0.

To illustrate, with respect to the above quantities, sulfamic acid, which contains one mole of amino moieties per mole of the compound, is easily computed in the above relation: [A] is simply the number of moles of sulfamate; but to give another illustration, when melamine is used, [A] is the number of moles of melamine used multiplied by the number of moles (which is 3) of amino moieties contained in any one mole of melamine.

Ingredients

Hypochlorite Source

In general, any convenient hypochlorite source can be used in the instant process. Preferred hypochlorite sources are selected from chlorine, hypochlorous acid, alkali metal hypochlorites, alkaline earth metal hypochlorites, the product of mixing a hypochlorite-liberating compound with aqueous alkali, and mixtures thereof. Suitable hypochlorite-liberating compounds, in the sense immediately above, are illustrated by dichloroisocyanuric acid and its sodium salts and hydrates, which hydrolyze rather readily to release hypochlorite. Highly preferred hypochlorite sources herein are selected from alkali metal hypochlorites and the product of mixing said hypochlorite-liberating compound and aqueous alkali.

Aminofunctional compound

From the thousands of available aminofunctional compounds, the present invention selects a limited few which are found operative. In processes of the invention, suitable aminofunctional compounds are those having stable N-halo derivatives. The term "having a stable N-halo derivative" herein is defined as "capable of forming an N-halo derivative and it is stable", rather than as necessarily "possessing a stable N-halo moiety at the inception of the present process". Suitable aminofunctional compounds meeting the needs of the present invention are selected from (i) primary aminofunctional compounds selected from sulfamic acid, alkali-metal sulfamates, alkaline earth sulfamates, tetra-alkylammonium sulfamates, and mixtures thereof; (ii) secondary aminofunctional compounds selected from secondary amine derivatives having formula RR'NH or $(R'')_2NH$ wherein R, R' and R" are organic moieties and wherein carbon atoms of said organic moieties are bonded covalently to NH; (iii) sulfonamides selected from sulfamide, p-toluenesulfonamide, imidodisulfonamide, benzenesulfonamide, alkyl sulfonamides, and mixtures thereof; (iv) melamine, cyanamide; and (v) mixtures thereof.

Suitable secondary aminofunctional compounds (ii) include those not specifically identified in (i), (iii), (iv) and (v), wherein R, R' and R" are independently selected from C1–C12 linear saturated and C3–12 branched saturated moieties which can be alkyl, aryl or heterocyclic, optionally substituted by carboxylic acid or carboxylate: an example of the latter carlxylic-substituted derivatives is the alpha-aminobutyrates. Preferred secondary aminofunctional compounds are known for use as disinfectants, especially those which are water-soluble and those having N-halo derivatives which are relatively insensitive to shock.

In alternate terms, the present process is believed to be applicable wherever the aminofunctional compound has a hydrolysis constant, K, as defined by $$K=[HOCl][RNH_2] / [RNHCl]$$

$$\text{or } K=[HOCl][RR'NH] / [RR'NCl]$$

$$\text{or } K=[HOCl][(R'')_2NH] / [(R'')_2NCl]$$

in the range of from about $10^{-6}$ to about $10^{-9}$, provided that no isocyanurate or chlorinated isocyanurate is included as the essential aminofunctional compound.

Hydrolysis constants such as the above are well known in the art and are defined conventionally. See, for example, Kirk Othmer's Encyclopedia of Chemical Technology, 3rd Ed., Vol. 5, article entitled "Chloramines and Bromamines", see especially page 567, and Kirk Othmer's Encyclopedia of Chemical Technology, 3rd Ed., Vol. 3, see especially pages 940–941, these articles being incorporated herein by reference.

Subject to the above-identified requirements, preferred secondary aminofunctional compounds can be selected from those identified in Kirk Othmer, Encyclopedia of Chemical Technology, 4th. Ed., 1993, pages 918–925 and include compounds identified under the headings "Organic Chloramines and Bromamines", "Aliphatic Compounds", "Aromatic Compounds" and "Heterocyclic Compounds".

Sulfamic acid or sodium sulfamate are highly preferred aminofunctional compounds herein.

Alkali

Suitable alkali in the present process is selected from alkali-metal-, alkaline-earth-, and tetraalkylammonium-oxides, hydroxides, carbonates, bicarbonates, silicates, phosphates, borates, and mixtures thereof.

Bromine compound

Suitable bromine compounds in the present process are selected from the group consisting of bromine, water-soluble bromide salts, water-soluble hypobromite salts, hypobromous acid, and mixtures thereof.

Overall Preferred Combinations of Ingredients

In an overall preferred process herein, said hypochlorite source is selected from alkali metal hypochlorites and the product of mixing a hypochlorite-liberating compound and aqueous alkali; said aminofunctional compound is selected from sulfamic acid, alkali-metal sulfamates, alkaline earth sulfamates, tetra-alkylammonium sulfamates, and mixtures thereof; and said bromine compound is selected from the group consisting of water-soluble bromide salts. Highly preferred herein is a process wherein said hypochlorite source is sodium hypochlorite, said aminofunctional compound is sulfamic acid; and said bromine compound is selected from sodium bromide, potassium bromide and mixtures thereof.

Ingredients or Impurities Desirably Excluded

The present process and product thereof preferably limits certain compounds which have been found to adversely affect product stability and effectiveness. Especially undesirable compounds herein are those aminofunctional compounds which do not form stable N-halo derivatives. Such compounds include simple ammonium ($NH_4^+$) salts, such as ammonium sulfate; urea; amino acids such as aspartic acid; and mixtures thereof, any of which may, for example, produce unpleasant odors of undesirable chloramines. Preferred herein are processes wherein throughout, and at least in the essential aminofunctional compound, no ingredient comprises more than about 1% of aminofunctional impurity compounds having unstable N-halo derivatives. Translating this requirement in practical terms, sulfamic acid is commercially available in a range of grades, certain of which may include urea as an impurity.

The crystal grade of sulfamic acid, which minimizes urea impurity, is found to be preferred. In other process embodiments, the present process is conducted using starting materials which are all water-soluble that is to say, excluding insoluble materials such as abrasives, thereby avoiding any tendency for surface-catalyzed bleach decomposition.

Acids and Bases for pH Adjustment

Any convenient alkali or base can be used herein as a pH-adjusting agent for increasing pH, and any convenient acid can be used herein as a pH-adjusting agent for decreasing pH; always provided that such alkali or acid is non-reactive with hypohalite. Preferred alkalis for pH adjustment include water-soluble alkalis such as sodium hydroxide, potassium hydroxide or mixtures thereof, and preferred acids include the common mineral acids such as sulfuric, hydrochloric or nitric, though sulfuric is preferred in this group. Alternately relatively weak adds can be used; these include acetic acid.

Examples of bases which knowledgeable practitioners will avoid entirely in the present process include ammonia because it is chemically reactive with other essential ingredients herein for purposes other than pH change, forming, for example, an undesirable type of chloramine when it reacts with hypochlorite.

In general, any simple mineral acid or base additions in the present process will be carried out in a manner consistent with preserving the chemical integrity of the aminofunctional compound. For example, when using sulfamic acid as the aminofunctional compound, mineral acid additions are conducted under sufficient dilution to avoid decomposition of the sulfamic acid. Concentrated nitric acid, for example, is known to decompose sulfamic acid at $HNO_3$ concentrations of 73%, especially at elevated temperatures, with formation of nitrous oxide, and such combination of concentrated mineral acid and elevated temperature is avoided in the instant process.

Water

Water used for making liquid compositions according to the present process is suitably city water. In general, hard, soft, softened or deionized water may be used. Distilled or reverse-osmosis treated water are especially desirable. When using water of uncertain quality, for example ferruginous water or high-manganese water from boreholes, it is desirable to reduce the dissolved metal content by conventional water treatment approaches, for example, oxygenation, filtration, and settling. Moreover a chelant or sequestrant can be used to treat process water. It is prudent to monitor or periodically check, and if needed, minimize transition metal ion content of the water by conventional techniques since transition metal ions are well known to affect bleach product stability. Suitable analysis is by atomic absorption spectroscopy or inductively coupled plasma spectroscopy (ICP).

pH Measurement pH herein is measured using a glass electrode or combination electrode such as Coming General Purpose Combination electrode Cat. No. 476530, and a commercial pH meter such as the Φ 40 pH meter available from Beckman.

pH Ramping

It is desirable, and indeed characteristic of the present process as best currently known, for there to be present a downward pH ramp (a "ramp" herein being a relatively linear increase or decrease in pH with time) followed by an upward pH ramp, there being a strong minimum in the pH as indicated in the process definition. In the latter part of the process, as noted hereinabove, the upward ramp of pH, measurable by dpHldt, is specifically in a defined range believed to be linked to stability and performance.

Bleach ingredient measurement: Available Chlorine

The term "Available Chlorine" sometimes abbreviated "$AvCl_2$" as used herein is described in Kirk Othmer's Encyclopedia of Chemical Technology, Vol. 4, 4th Ed. (1992) pages 274–275 published by Wiley-Interscience.

Reactions which produce an oxidant from chlorine include the following:

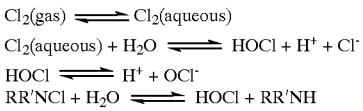

$$Cl_2(gas) \rightleftharpoons Cl_2(aqueous)$$
$$Cl_2(aqueous) + H_2O \rightleftharpoons HOCl + H^+ + Cl^-$$
$$HOCl \rightleftharpoons H^+ + OCl^-$$
$$RR'NCl + H_2O \rightleftharpoons HOCl + RR'NH$$

The total concentration or amount of any given chlorine-based oxidant is often pressed on an equivalent basis, as though all the oxidant were chlorine. Available Chlorine is thus the equivalent concentration or amount of chlorine needed to produce an oxidant, for example according to the above reactions, and can be measured by conventional measures, such as iodometric methods referenced in Kirk-Othmer (op. cit).

Available Chlorine can be calculated from the following relation:

Available Chlorine (%)=70.9× moles of oxidant× (number of active CI atoms / molecule)×100

In the above relation, the term "active Cl atoms" needs definition: Because $Cl_2$ only accepts two electrons, as does HOCI and monochloroamines, it has only one "active" Cl atom according to the present definition.

When determining the Available Chlorine expected for product of the instant process, "moles of oxidant" in the above relation is replaced by "total moles of bleaching halogen added in forming the composition".

Note that "Available Chlorine" can be determined for bleaches that do not actually form hypochlorite in solution, such as bromine-containing bleaches, and other nonchlorine bleaches, by substituting the number of electrons accepted divided by two for the number of active chlorine atoms in the above relation. This can also be measured by iodometric titration.

Note also that the Available Chlorine unit is a dimensionless percentage, not a percentage by weight. It should be apparent from the definition that it is in fact possible in general terms to obtain Available Chlorine values which exceed 100%; this can happen in the case of a chlorine bleach which is more mass efficient than $Cl_2$, recalling that only one chlorine atom in $Cl_2$ is a bleaching chlorine atom; however, such levels are not encountered in the present process.

Amounts and Ratios of ingredients

In general, amounts and aqueous concentrations of ingredients herein may vary quite widely; nonetheless there is a strong preference for particular interhaogen ratios as defined elsewhere herein and it is commercially attractive to use ingredients such as sodium hypochlorite at the most economic concentrations provided by their manufacturers.

Advantages

As noted, the present invention has significant advantages, for example improved bleaching. By "improved bleaching" it is meant herein that a composition obtainable with the process of the present invention delivers better bleaching performance on bleachable stains like tea stains, as compared to the bleaching performance delivered by the same composition made by another process, for example one involving numerous alternate orders of addition or mixing of the ingredients. Importantly, concurrent with improved bleaching, the formulations provided by the process leave low residual odor on skin and are milder than those otherwise manufactured with different ingredient selections and/or orders of addition. In short the combination of overall performance and desirable skin safetylaesthetics offered by the present process are believed to be measurably superior to those attainable by any art-recognized process.

Product Characteristics

The product of the present process is not in general limited as to form, though it is highly preferred for the compositions produced to be aqueous liquids or aqueous gels. Another product form potentially preferred herein is a "high-solubility solid concentrate" or "high solubility tablet" form. Such product forms are free from abrasives. The product of the process is preferably transparent, and, as described elsewhere herein, may be both colored and perfumed.

Processing of Optional Ingredients

The present process and the product thereof allow for the presence of at least one additional mixing step other than the essential minimum (a), (b), (c); wherein there is added an ingredient selected from the group consisting of surfactants, buffers, builders, chelants, perfumes, colorants, dyes, bleach stabilizers, pigments, suds supressors, anti-tamish and/or anti-corrosion agents, soil-suspending agents, germicides, alkalinity sources, hydrotropes, anti-oxidanta, clay soil removavanti-redeposition agents, thickeners, solvents, and mixtures thereof. For other optional ingredients, see U.S. Pat. No. 3,583,922 or other references cited in the background, recognizing that '922 relates to solid compositions as distinct from the liquids herein.

Other Ramifications

The present process can accomodate perfumes and colorants, most particularly known bleach-stable colorants such as various yellows; and perfumes offering citrus or pine character. Perfumes for use herein are desirably hydrophobic, having relatively high octanol/water partition coefficients such as 6 or above. In process terms, it has been found desirable to incorporate perfume in a step which follows (III) (a). Without being limited by theory, this is believed to be due to a reduced tendency for reaction of sulfamate derivatives with perfume aldehydes when they are incorporated late in the process. Also desirably, bleach-stable thickeners such as those referenced in background and/or Laponite®, a special day available from Laport, and/or fatty amine oxides may be combined using the present process to deliver product having a wide range of useful properties.

Optional Incredients in More Detail

Optional ingredients are now nonlimitingly illustrated in more detail. Such ingredients as noted include surfactants, bleach stabilizers, colorants, suds boosters, suds supressors, anti-tarnish and/or anti-corrosion agents, soil-suspending agents, germicides, alkalinity sources, hydrotropes, anti-oxidants, day soil removal/anti-redeposition agents, polymeric dispersing agents, and the like; and mixtures thereof.

The processes herein may make use of, based on the composition of the product, from about 0.1 % to about 95% of a surfactant or mixtures thereof selected from the group consisting of anionic, nonionic, ampholytic and zwitterionic surface active agents. For liquid systems, surfactant is preferably present to the extent of from about 0.1 % to 20%, though higher levels, e.g., 30% are possible, for example in viscous gels, aqueous pastes or semi-solids.

Anionic surfactants herein can include water-soluble salts, particularly the alkali metal salts, of $C_8$–$C_{22}$ organic sulfuric reaction products and a radical selected from the group consisting of sulfonic acid and sulfuric acid ester radicals. Sodium or potassium alkyl sulfates, especially those obtained by sulfating $C_8$–$C_{18}$ alcohols are useful, as are linear or branched alkyl benzene sulfonates especially the $C_9$–$C_{15}$ alkyl-substituted sodium- or potassium- salt forms; also useful are the sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids derived from coconut oil sodium or potassium salts of fatty acid amides of a methyl tauride in which the fatty acids, for example, are derived from coconut oil; and sodium or potassium beta-acetoxy- or beta-acetamido-alkanesulfonates where the alkane has from 8 to 22 carbon atoms.

Additionally, conventional primary alkyl sulfates, such as those having the general formula $ROSO_3^-M^+$ wherein R is typically a linear $C_8$–$C_{22}$ hydrocarbon group and M is a water solublizing cation are useful herein, as are the secondary alkyl sulfates and/or branched chain primary alkyl sulfate surfactants (i.e., branchd-chain "PAS") having 8–20 carbon atoms, see EP 439,316 A Smith et al. Secondary alkyl sulfate surfactants include those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 17, and M is a water-solublizing cation.

In addition, the selected secondary (2,3) alkyl sulfate surfactants used herein may comprise structures of formulas I and II $$CH_3(CH_2)_x(CHOSO_3^-M^+)CH_3I$$

$$CH_3(CH_2)_y(CHOSO_3^-M^+)CH_2CH_3I$$

for the 2-sulfate and 3-sulfate, respectively. Mixtures of the 2- and 3-sulfate can be used herein. In formulas I and II, x and (y+1) are, respectively, integers of at least about 6, and can range from about 7 to about 20, preferably about 10 to about 16. M is a cation, such as an alkali metal, ammonium, alkanolammonium, triethanol-ammonium, potassium, ammonium, and the like, can also be used.

The aforementioned secondary alkyl sulfates are those prepared by the addition of $H_2SO_4$ to olefins. A typical synthesis using alpha olefins and sulfuric acid is disdosed in U.S. Pat. No. 3,234,258, Morris, issued Feb. 8, 1996 or in U.S. Pat. No. 5,075,041, Lutz, issued Dec. 24, 1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3- sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

Especially preferred surfactants for use in the present process are those having the highest possible bleach stability, including $C_8$–$C_{22}$ fatty amine oxides such as hexadecyidimethylamine N- oxide or saturated fatty alkyl alkoxylates. Particularly objectionable surfactants are those having a high degree of unsaturation, and any surfactants comprising hypohalite-reactive nitrogen moieties. Somewhat less problematic, but still a potential source of difficulty, are the use of any alcohols. Thus, when using alkyl ethoxylates, etc., the so-called "capped" forms in which terminal —OH is replaced by —$OCH_3$ or similarly unreactive groups, is particularly preferred.

The most bleach-stable and hydrolytically-stable surfactants can be added at various stages of the present process, but for convenience, their addition will generally be done in such manner as to minimize foaming which may undesirably slow down the process. Silicone anti-foams are desirable for limiting foam; such anti-foams are commercially available from Dow Corning Corp.

When processing a surfactant having susceptibility to acid hydrolysis, such as an alkyl sulfate, it is incorporated into the product in the present process at any point at which the pH of the mixture of ingredients has exceeded about 7, preferably, when said pH has exceeded about 8.

Although preferred processes and compositions herein are free from insoluble materials and are non-abrasive, products of the present process can be formulated in a solid or viscous semi-solid form further comprising an abrasive material, such as expanded perlite abrasive in combination with the surfactants, filler material, or other optional scouring material ingredients listed herein. When desired, abrasive materials can be those contained in U.S. Pat. No. 4,051,056, Hartman, issued Sep. 27, 1977.

Other optional ingredients to be used herein include buffers, for purposes which include to adjust the cleaning surface pH to optimize the hard surface cleaner composition effectiveness relative to a particular type of soil or stain. Buffers may also be included to stabilize the adjunct ingredients with respect to extended shelf life or for the purpose of maintaining compatibility between various aesthetic ingredients. The hard surface cleaner of the present invention optionally contains buffers to help adjust and maintain the pH at about 13 or in a range above about 13. Non-limiting examples of such suitable buffers are potassium carbonate, sodium carbonate, and trisodium phosphate, however, the formulator is not restricted to these examples or combinations thereof.

The cleaning compositions obtainable according to the process of the present invention may also desirably be prepared with inclusion of a heavy metal ion control system, especially one comprising one or more agents for the control of bleach destabilization caused by soluble, insoluble or colloidal iron and/or manganese and/or copper. A simple but effective agent is sodium tripolyphosphate, optionally supported by at least partially polymeric hydrous sodium silicate. Examples of other chelating or heavy-metal control agents are phytic acid and ethane-1-hydroxy-1,1-diphosphonic acid (EHDP), though other materials, such as a number of commercial phosphonate types, may be used. Preferred chelating agents herein, are free from alcohol sites, halogen-reactive nitrogen donor sites, and hydroltically sensitive sites. In process terms, a preferred addition of at least some chelating agent or heavy-metal ion control agent takes place at or near the beginning of the process, for example immediately before, or concurrent with, step I(a). However, when adding a silicate for the purpose at least in part of helping control heavy metal ions, it is added at a point in the process which is remote from both the pH minimum and the pH maximum of the process Perfumes when used are typically at levels of from 0% to 5%. See U.S. Pat. No. 4,246,129, Kacher, issued Jan. 20, 1981.

The compositions obtainable according to the process of the present invention typically have a yellow color. However, it is possible to provide a preferred solution which has some other color, for example, by the addition of a bleach-stable dye; moreover, preferred solutions may readily be diluted, in which case yellow color is difficult to detect. In process terms, dyes are preferably added at the end of the process, in which case product-making can be more conveniently monitored on a colorant-free product.

The liquid compositions obtainable according to the process of the present invention may be formulated with different viscosities. In one embodiment of the present invention the compositions obtainable with the process herein have a viscosity of from about 1 to about 150 cps. Said compositions are convenient for spray bottle application. Likewise, said liquid compositions obtainable according to the present invention can be further thickened, e.g., by the addition of additional bleach-stable thickener, such as the commercially available DOWFAX. A suitable gel formulation has a viscosity of from about 100 cps to about 2000 cps, preferably from 300 cps to 1000 cps as measured, for example, by techniques and methods described in "Physico-Chemical Methods", Reilly, J. and Rae, W. N.; Vol. 1 (5th ed.), pages 667–692; D. Van Nostran pub. Thickeners, when added in the instant process, are desirably used toward the end of the process, for example, adding them immediately after, or concurrent with, stage (III).

EXAMPLE 1

(I) Pre-Bromine Stage

All operations are conducted at ambient temperature, about 20° C. 30 grams distilled water is placed in a chemically inert, plastic-lined reaction vessel. The vessel is set for operation at atmospheric pressure and as a precaution is connected to a scrubber for removing any minor quantity of chlorine vapors which might be emitted. The vessel is equipped with an inert-plastic-coated paddle stirrer. While stirring at 300 rpm, 13.05 grams of aqueous sodium hypochlorite, assayed as comprising 10.73% Available Chlorine, is added. Immediately thereafter, sulfamic acid (2.2 grams, Aldrich, 99.3%, crystalline) is added with continued stirring until the added solid has dissolved. At this point, the pH of the stage (I) mixture is about 1.0.

(II) Bromine Compound Addition Stage

To the stirred stage (I) mixture is added Sodium Bromide (0.5 grams, EM Science). The mixture is stirred until the added solid has dissolved (about 5 minutes) and a yellow color has appeared. The mixture at this point is identified as a Stage (II) mixture.

(III) Product Stabilization Stage

To the stirred stage (II) mixture is added Sodium Hydroxide (about 3.0 grams, 50% in water) until the pH of the mixture is about 13.2. Water is added until the total weight of the stage (III) mixture is about 100 grams.

EXAMPLE II

The process of Example I is repeated with the following differences: The scale of operations is increased 1000-fold. In a pre-processing step, chlorine gas is passed into sodium hydroxide solution, forming sodium hypochlorite solution. The sodium hypochlorite solution is passed into the above-identified reactor in batches, where it is treated with sulfamic acid, forming a stage (I) mixture. Steps subsequent to stage (I) are conducted in the manner of Example I.

EXAMPLE III

The process of Example II is repeated with the following difference: Sodium Sulfamate is substituted for sulfamic acid.

In the examples below, a heavy line indicates the boundary separating Stages (I), (II) and (III) of the process.

EXAMPLE IV

The process of Example III is repeated with the following difference: prior to completion of Stage I, aqueous hydrochloric acid is added to reduce the pH to about 7.0.

| Ingredient | Addition Sequence | % wt |
|---|---|---|
| Hydrous Sodium Silicate (Britesil H2O, PQ Corp.) | (2) | 0.20 |
| Sodium Tripolyphosphate | (3) | 0.20 |
| First portion | | |
| Sodium Hypochlorite | (4) | 0.90 |
| Sulfamic Acid | (5) | 1.30 |
| Potassium Bromide | (6) | 1.10 |
| Sodium Tripolyphosphate | (7) | 7.60 |
| Second Portion | | |
| Sodium Hydroxide | (8) | 0.80 |
| Cocodimethylamine N-Oxide | (9) | 0.25 |
| Dye | (10) | 0.15 |
| Perfume | (11) | 0.60 |
| Water | (1) and (12) . | bal. |

("bal." means "balance to 100%")

| Ingredient | Addition Sequence | % wt |
|---|---|---|
| Sodium Hypochlorite | (2) | 1.4 |
| Sulfamic Acid | (3) | 1.9 |
| Sodium Silicate | (4) | 0.04 |
| Sodium Bromide | (5) | 1.8 |
| Sodium Hydroxide | (6) | 1.6 |

-continued

| Ingredient | Addition Sequence | % wt |
|---|---|---|
| Surfactant | (7) | 3.5 |
| Dyes/perfume | (8) | 0.28 |
| Water | (1) and (9) | bal. |

Note:
*"Surfactant" refers to C8 Alkyl Sulfate, C12–C14 Dimethylamine N-Oxide or a mixture thereof.

| Ingredient | Addition Sequence | % wt |
|---|---|---|
| Sodium Hypochlorite | (1) | 1.4 |
| Sodium Sulfamate/ Sulfuric acid | (2) | 2.2** |
| Sodium Bromide | (3) | 1.5 |
| Potassium Bromide | (4) | 1.1 |
| Sodium Silicate | (5) | 0.05 |
| Perfume | (6) | 0.1 |
| Sodium Hydroxide | (7) | 1.8 |
| Sodium Octyl Sulfate | (8) | 5.5 |
| Yellow Dye | (9) | 0.28 |
| Water | (10) | bal. |

("bal." means "balance to 100%")
**weight equivalent to sulfamic acid content, dry basis

| Ingredient | Addition Sequence | wt % |
|---|---|---|
| Cocodimethylamine N-oxide | (1) | 3.0 |
| Sodium Sulfamate/Sulfuric acid | (2) | 0.5** |
| Calcium Hypochlorite | (3) | 0.5 |
| Sodium Dichlorocyanurate | (4) | 0.50 |
| Potassium Bromide | (5) | 1.5 |
| Sodium Hydroxide | (6) | 0.8 |
| Sodium Tripolyphosphate | (7) | 1.6 |
| Sodium Acetate | (8) | 0.3 |
| Potassium Hydroxide | (9) | 0.85 |
| Sodium Octyl Sulfate | (10) | 3.00 |
| Dyes/perfume | (11) | 0.28 |
| Water | (12) | bal. |

**weight equivalent to sulfamic acid content, dry basis

| Ingredient | Addition Sequence | wt % |
|---|---|---|
| Surfactant | (2) | 6.1 |
| Sodium Dichlorocyanurate | (3) | 1.2 |
| Melamine | (4) | 0.23 |
| Potassium Bromide | (5) | 1.0 |
| Tetrapotassium Pyrophosphate | (6) | 13.0 |
| Tripotassium Phosphate | (7) | 12.0 |
| Sodium Silicate | (8) | 0.5 |
| Calcium Carbonate | (9) | 39.0 |
| Calcium Oxide | (10) | 2.8 |
| Perlite Abrasive | (11) | 22.5 |
| Sodium Hydroxide | (12) | 1.1 |
| Water | (1) and (13); split 1:1 by weight | bal. |

Note 1:
*"Surfactant" refers to C8 Alkyl Sulfate, C12–C14 Dimethylamine N-Oxide or a mixture thereof.

What is claimed is:

1. A process for manufacturing a bleaching composition comprising the steps of:

a) admixing a source of hypohalite and an aminofunctional compound having the formula:

RR'NH wherein R and R' are independently hydrogen, an organic or inorganic unit, and mixtures thereof, provided both R and R' are not both hydrogen, to form a pre-bromine admixture having a pH not exceeding about 11;

b) adding to the pre-bromine admixture a source of bromine to form a bromine addition admixture; and c) adjusting the pH of the bromine addition admixture to at least about 13 forming a bleaching composition.

2. A process according to claim 1, wherein said aminofunctional compound is selected from the group consisting of:

i) primary aminofunctional compounds selected from sulfamic acid, alkali metal sulfamates, alkaline earth sulfamates, terta-alkylammonium sulfamates, or mixtures thereof;

ii) secondary amine derivatives having the formula:

$RR'NH$ or $(R'')_2NH$ wherein R, R', and R" are organic moieties and wherein carbon atoms of said moieties are bonded to NH;

iii) sulfonamides selected from sulfamide, p-toluenesulfonamide, imidodisulfonamide, benzenesulfonamide, alkyl sulfonamides, or mixtures thereof;

iv) melamine, cyanamide, or mixtures thereof;

v) and mixtures thereof.

3. A process according to claim 1, wherein said source of hypohalite in (a) is selected from the group consisting of chlorine gas, hypochlorous acid, alkali metal hypochlorites, alkaline earth metal hypochlorites, and mixtures thereof.

4. A process according to claim 1 wherein said source of hypohalite in (a) is introduced by admixing a hypohalite-liberating compound with a source of aqueous alkali in the presence of the aminofunctional compound such that the final pH of the pre-bromine admixture does not exceed about 11.

5. A process according to claim 1 wherein said source of bromine is selected from the group consisting of bromine, water-soluble bromide salts, water-soluble hypobromite salts, hypobromous acid, and mixtures thereof.

6. A process according to claim 1 wherein the ratio of the number of moles of hypohalite added in (a) to the number of moles of aminofunctional compound added in (a) is from about 10:1 to about 1:10.

7. A process according to claim 1 wherein the ratio of the number of moles of hypohalite added in (a) to the number of moles of said source of bromine added in (b) is from about 10:1 to about 1:10.

8. A process according to claim 1 wherein steps (b) and (c) are conducted at a temperature of from about 5° C. to about 80° C.

9. A process according to claim 1, wherein the pH of the pre-bromine admixture of step (a) is not in excess of about 8.

10. A process according to claim 9 wherein the pH of the pre-bromine admixture of step (a) is from about 1 to about 6.9.

11. A process according to claim 1 further comprising the step of adding to the bleaching composition formed in step (c) one or more carriers.

12. A process according to claim 1 further comprising the step of adding to the bleaching composition formed in step (c) one or more adjunct ingredients, said adjunct ingredients selected form the group consisting of surfactants, buffers, builders, chelants, abrasives, perfumes, colorants, dyes, bleach stabilizers, pigments, color speckles, suds suppressors, anti-tarnish agents, anti-corrosion agents, soil-suspending agents, germicides, alkalinity sources, hydrotropes, anti-oxidants, clay soil removal agents, anti-redeposition agents, thickeners, solvents, and mixtures thereof.

13. A process according to claim 1 wherein said bleaching composition formed in step (c) has from about 0.01% to about 10% available chlorine.

14. A process for manufacturing a bleaching composition comprising the steps of:

a) admixing a source of hypohalite and an aminofunctional compound, at a temperature of from about 5° C. to about 80° C., to form a pre-bromine admixture having a pH not exceeding about 11;

b) adding to the pre-bromine admixture, at a temperature of from about 5° C. to about 80° C., a source of bromine to form a bromine addition admixture; and c) adjusting the pH of the bromine addition admixture to at least about 13, at a temperature of from about 5° C. to about 80° C., to forming a bleaching composition.

15. A process according to claim 14, wherein said aminofunctional compound is selected from the group consisting of:

i) primary aminofunctional compounds selected from sulfamic acid, alkali metal sulfamates, alkaline earth sulfamates, terta-alkylammonium sulfamates, or mixtures thereof;

ii) secondary amine derivatives having the formula:

$$RR'NH \text{ or } (R'')_2NH$$

wherein R, R', and R" are organic moieties and wherein carbon atoms of said moieties are bonded to NH;

iii) sulfonamides selected from sulfamide, p-toluenesulfonamide, imidodisulfonamide, benzenesulfonamide, alkyl sulfonamides, or mixtures thereof;

iv) melamine, cyanamide, or mixtures thereof;

v) and mixtures thereof.

16. A process according to claim 14, wherein said source of hypohalite in (a) is selected from the group consisting of chlorine gas, hypochlorous acid, alkali metal hypochlorites, alkaline earth metal hypochlorites, and mixtures thereof.

17. A process according to claim 14 wherein said source of bromine is selected from the group consisting of bromine, water-soluble bromide salts, water-soluble hypobromite salts, hypobromous acid, and mixtures thereof.

18. A process according to claim 14 further comprising the step of adding to the bleaching composition formed in step (c) one or more carriers or one or more adjunct ingredients, said adjunct ingredients selected form the group consisting of surfactants, buffers, builders, chelants, abrasives, perfumes, colorants, dyes, bleach stabilizers, pigments, color speckles, suds suppressors, anti-tarnish agents, anti-corrosion agents, soil-suspending agents, germicides, alkalinity sources, hydrotropes, anti-oxidants, clay soil removal agents, anti-redeposition agents, thickeners, solvents, and mixtures thereof.

19. A process according to claim 14 wherein said bleaching composition formed in step (c) has from about 0.01% to about 10% available chlorine.

20. A process for manufacturing a bleaching composition comprising the steps of:

a) admixing a source of hypohalite, said source of hypohalite is selected from the group consisting of alkali metal hypochlorites, alkali earth metal hypochlorites, and mixtures thereof, and an aminofunctional compound, said amino compound selected from the group consisting of sulfamic acid, sulfamate salts thereof, and mixtures thereof, such that the ratio of the number of moles of hypohalite added to the number of moles of aminofunctional compound added is from about 10:1 to about 1:10, to form a pre-bromine admixture having a pH from about 1 to about 6.9;

b) adding to the pre-bromine admixture a water-soluble bromide salt in an amount such that the ratio of the number of moles of hypohalite added in (a) to the number of moles of water-soluble salt added in (b) is from about 10:1 to about 1:10, to form a bromine addition admixture;

c) adjusting the pH of the bromine addition admixture to at least about 13 forming a bleaching composition wherein said bleaching composition has from about 0.01% to about 10% available chlorine;

d) optionally diluting said bleaching composition with a carrier; and e) optionally adding to said bleaching composition one or more adjunct ingredients.

* * * * *

UNITED STATES PATENT AND TRADEMARK OFFICE

CERTIFICATE OF CORRECTION

PATENT NO. : 6,037,318
DATED : March 14, 2000
INVENTOR(S) : H.C. Na et al.

It is certified that error appears in the above-identified patent and that said Letters Patent is hereby corrected as shown below:

Column 1,
Line 63, "add" should read --acid--.
Line 67, "dish washing" should read --dishwashing--.

Column 3,
Line 6, "Initiated" should read --initiated--.
Line 46, "hypohalit" should read --hypohalite--.
Line 57, "soure" should read --source--.

Column 7,
Line 14, "carlxylic" should read --carboxylic--.

Column 8,
Line 39, "adds" should read --acids--.

Column 9,
Line 11, "Coming" should read --Corning--.
Line 39, "pressed" should read --expressed--.

Column 10,
Line 11, "interhaogen" should read --interhalogen--.
Line 29-30, "safetylaesthetics" should read --safety/aesthetics--.
Line 51, "anti-oxidanta" should read --anti-oxidants--.
Line 52, "removavanti-redeposition" should read --removal/anti-depeposition--.

Column 11,
Line 3, "day" should read --clay--.
Line 3, "Laport" should read --Laporte--.
Line 13, "day" should read --clay--.
Line 53, "branchd-chain" should read --branched-chain--.
Line 67, "$CH_3(CH_2)_x(CHOSO_3^-M^+)CH_3I$" should read
--$CH_3(CH_2)_x(CHOSO_3^-M^+)\ CH_3\ I$--.

Column 12,
Line 1, "$CH_3(CH_2)_y(CHOSO_3^-M^+)CH_2CH_3I$" should read
--$CH_3(CH_2)_y(CHOSO_3^-M^+)\ CH_2CH_3\ II$ --.

UNITED STATES PATENT AND TRADEMARK OFFICE

CERTIFICATE OF CORRECTION

PATENT NO. : 6,037,318
DATED : March 14, 2000
INVENTOR(S) : H.C. Na et al.

It is certified that error appears in the above-identified patent and that said Letters Patent is hereby corrected as shown below:

Column 12,
Line 11, "disdosed" should read --disclosed--.
Line s 28-29, "hexadecyidimethylamine" should read --hexadecyldimethylamine--.

Column 13,
Line 19, "hydroltically" should read --hydrolytically--.
Line 27, "process" should read --process.--.

Column 14,
Line 41, insert --EXAMPLE V--.
Line 59, insert --EXAMPLE VI--.

Column 15,
Line 12, insert --EXAMPLE VII--.
Line 29, insert --EXAMPLE VIII--.
Line 44, insert --EXAMPLE IX--.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*